US006896138B2

(12) United States Patent
Röck et al.

(10) Patent No.: US 6,896,138 B2
(45) Date of Patent: May 24, 2005

(54) CHILDPROOF BLISTER PACK

(75) Inventors: Nina Röck, Ditzingen (DE); Günter Kayran, Ostfildern (DE); Bernhard Hegemann, Filderstadt (DE)

(73) Assignee: Uhlmann Pac-Systeme GmbH & Co. KG, Laupheim (DE)

( * ) Notice: Subject to any disclaimer, the term of this patent is extended or adjusted under 35 U.S.C. 154(b) by 0 days.

(21) Appl. No.: 10/783,978

(22) Filed: Feb. 20, 2004

(65) Prior Publication Data

US 2004/0188314 A1 Sep. 30, 2004

(30) Foreign Application Priority Data

Feb. 22, 2003 (DE) ..... 103 07 590

(51) Int. Cl.[7] ..... B65D 83/04
(52) U.S. Cl. ..... 206/531; 206/532; 206/538
(58) Field of Search ..... 206/531, 534, 206/538, 539, 530, 532; 220/345.1, 345.2, 345.3, 348, 351, 345.4

(56) References Cited

U.S. PATENT DOCUMENTS 4,535,890 A * 8/1985 Artusi ..... 206/530
4,817,819 A * 4/1989 Kelly ..... 221/2
4,947,989 A * 8/1990 Horton ..... 206/387.1
5,150,793 A 9/1992 Tannenbaum
5,878,887 A * 3/1999 Parker et al. ..... 206/528
6,394,275 B1 5/2002 Paliotta
6,523,691 B2 * 2/2003 Raj et al. ..... 206/538
6,679,382 B1 1/2004 Kancsar

FOREIGN PATENT DOCUMENTS

| | | |
|---|---|---|
| DE | 29 19 713 | 11/1980 |
| DE | 38 40 080 | 5/1990 |
| DE | 101 17 910 | 8/2002 |
| WO | 03/042 066 | 5/2003 |

* cited by examiner

*Primary Examiner*—Shian T. Luong
(74) *Attorney, Agent, or Firm*—Herbert Dubno

(57) ABSTRACT

A blister pack has a main sheet unitarily formed with an array of pockets each dimensioned to receive a respective object and a frangible foil overlying a front face of the sheet and closing the pockets so that objects in the pockets are hermetically sealed therein by the foil. A pair of guides unitarily formed with the main sheet flank the array of pockets. A protective panel having an array of holes substantially identical to the array of pockets overlies the foil and is displaceable in the guides between a rest position with the holes at least partially offset from the pockets and the panel blocking the pockets and a dispensing position with the holes aligned with the pockets. A spring web unitarily formed with the sheet and with the panel urges the panel into the rest position.

5 Claims, 1 Drawing Sheet

Fig. II

CHILDPROOF BLISTER PACK

FIELD OF THE INVENTION

The present invention relates to a blister pack. More particularly this invention concerns such a blister pack that is child proof, that is difficult for a child to open.

BACKGROUND OF THE INVENTION

A standard blister pack as for example used to hold pills comprises a relatively stiff base sheet formed of plastic with a uniform array of pocket-forming blisters each holding a respective one of the pills. A relatively weak cover foil, typically aluminum, is adhered to a front face of the base sheet so as to close the pockets. A pill is removed from the pack by pressing its pocket forward, thereby deforming it and forcing the pill through the cover foil. In this manner the pills are kept separate in respective hermetically closed compartments until used, and it is very easy to keep track of how many have been taken and how many are left.

Making such a pack child proof or resistant is fairly difficult, as not only are the pills an often attractive item, but pushing them out can be considered amusing to a young child. If the foil is made tough enough that small fingers do not have the strength to force a pill through them, the pack becomes difficult to use for the elderly or infirm.

Hence it has been suggested in U.S. Pat. No. 5,150,793 of Tannenbaum to provide a device that holds the pack. This device wraps around the pack and has a front wall that overlies the foil-covered front face of the pack and that is formed with an array of holes matching the array of pockets of the pack. The pack can move in the device between a position with its pockets aligned with the holes in the device and a position with the pockets offset from the holes in the device. In addition the pack is formed with a spring-like end region that bears against the end of the protective device and that urges the pack into the misaligned position in which the pills cannot be forced through the holes in the device. Thus the user must use so-called biaxial movement, that is must shift the pack to the side against the spring force and then, while holding it against the spring force in this position, push out the desired pill.

Such a system is relatively effective in preventing a child from getting at the pills and also in fact prevents inadvertent pushing-out of pills. It is however relatively complex and adds considerably to the packaging costs for the pills.

OBJECTS OF THE INVENTION

It is therefore an object of the present invention to provide an improved childproof blister pack for pills and the like.

Another object is the provision of such an improved childproof blister pack for pills and the like which overcomes the above-given disadvantages, that is which is of simple and inexpensive construction.

SUMMARY OF THE INVENTION

A blister pack has according to the invention a main sheet unitarily formed with an array of pockets each dimensioned to receive a respective object and a frangible foil overlying a front face of the sheet and closing the pockets so that objects in the pockets are hermetically sealed therein by the foil. A pair of guides unitarily formed with the main sheet flank the array of pockets. A protective panel having an array of holes substantially identical to the array of pockets overlies the foil and is slidable in the guides between a rest position with the holes at least partially offset from the pockets and the panel blocking the pockets and a dispensing position with the holes aligned with the pockets so that in the dispensing position the objects can be pressed from the pockets through the foil and holes. A spring web unitarily formed with the sheet and with the panel urges the panel into the rest position.

Thus the pack is basically formed of two parts, the stiff plastic that forms the protective panel, spring, and sheet having the pockets, and the foil overlying it. This pack can be produced at very low cost so that, even though it has the desired and often legally mandated childproof features, it is as cheap to produce as a pack with no childproofing.

The system of this invention does not require any particular strength to open, so it is suitable for use by the aged or infirm. It requires biaxial movement, that is sliding the panel to the side and holding it there, then pushing out the pill or other object held in the pocket. Such biaxial movement is not readily executed by a child, and cannot happen accidentally so the pack according to the invention can be carried in a pocket or purse without fear of opening. In fact since the panel must normally project somewhat from the end of the pack in the dispensing position, outside forces acting on it will not open it.

According to the invention the spring web, panel, and sheet are of the same material and thickness. The material is a stiff plastic capable of being hot formed in to the desired shape.

The spring web in accordance with the invention has a pair of flat portions having outer edges joined to the panel and sheet and inner edges joined to each other. These portions form a V that makes a very effective spring. The dimensions of the spring web can be that, at maximum deformation, the holes are perfectly aligned with the pockets. Alternately to make the system even safer, the maximum deformation can correspond to a position with the holes moved clear past the pockets, so that the panel must be held in an intermediate position to get out the objects in the pockets, something very difficult for a child.

The guide is a pair of inwardly bent lips formed at longitudinal edges of the sheet, so that the longitudinal edges of the panel are covered, thereby further preventing accidental actuation of the panel.

BRIEF DESCRIPTION OF THE DRAWING

The above and other objects, features, and advantages will become more readily apparent from the following description, reference being made to the accompanying drawing in which.

SPECIFIC DESCRIPTION

Figure 3:
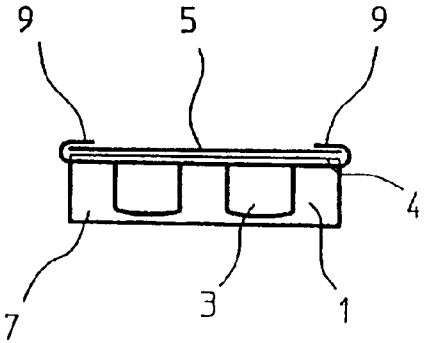
FIG. 3 is an end view taken in the direction of arrow III of FIG. 2.

As seen in the drawing, a blister pack 1 basically comprises a vacuum-formed and relatively stiff plastic base sheet 2 formed with a uniform array of ten pockets 3 each adapted to hold a pill P. A thin aluminum foil 4 overlies a front face of the sheet 2 and seals the pills P in the compartments formed by the pockets 3. This is standard.

According to the invention the sheet 2 is integrally formed with a protective panel 5, a spring 7, and a pair of guides 9.

More particularly, the panel 5, which is of the same stiff sheet material as the main sheet 2, is formed with an array of holes 6 correspondingly exactly to the pockets 3. The spring 7 is formed by a pair of flat webs 10 forming a V and having ends 11 attached to the ends of the sheet 1 and panel 5. The guides 9 are constituted as U-shaped turned-over longitudinal lips of the sheet 1 that engage over edges of the panel 5.

Figure 2:
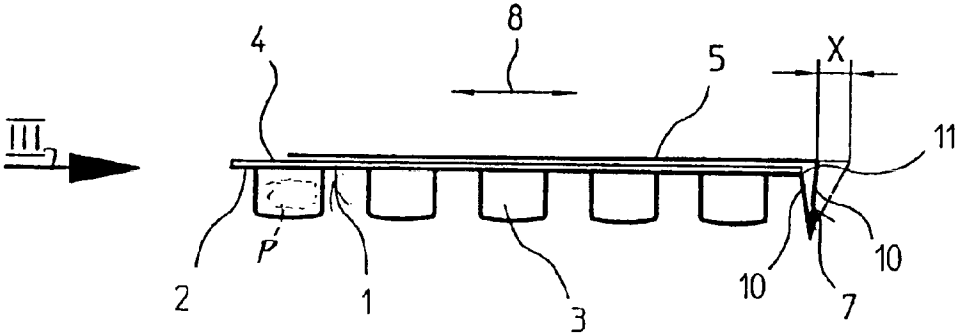
FIG. 2 is a side view taken in the direction of arrow II of FIG. 1.
Figure 1:
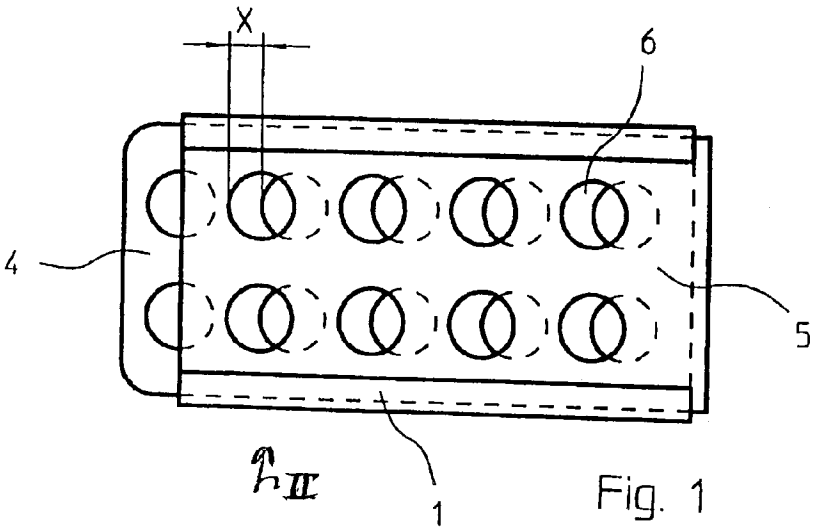
FIG. 1 is a top view of the blister pack according to the invention.

The spring 7 is constructed such that it normally urges the panel 5 in a longitudinal direction 8 toward the left as shown in FIGS. 1 and 2 into a position with the holes 6 out of registry with the pockets 3 by a distance x equal to the radius of the holes 6 and pocket 3. Thus in this rest position the pills P cannot be pushed from the pockets out through the holes 6. The webs 10 are dimensioned such that the panel 5 can be shifted toward the right as shown in FIGS. 1 and 2 through the distance x, and no more, so as to perfectly align the holes 6 with the pockets 3. In this position pills P can easily be pushed out of the pockets 3, through the foil 4 and through the holes 6 of the panel 5.

The dual movement required to do this is normally too difficult for a child. Nonetheless it does not require any particular strength so that a weak or infirm person can easily use the packaging according to this invention.

We claim:

1. A blister pack comprising:

a main sheet unitarily formed with an array of pockets each dimensioned to receive a respective object;

a frangible foil overlying a front face of the sheet and closing the pockets, whereby objects in the pockets are hermetically sealed therein by the foil;

a pair of guides unitarily formed with the main sheet and flanking the array of pockets;

a protective panel having an array of holes substantially identical to the array of pockets, overlying the foil, and slidable in a direction in the guides between a rest position with the holes at least partially offset from the pockets and the panel blocking the pockets and a dispensing position with the holes aligned with the pockets, whereby in the dispensing position the objects can be pressed from the pockets through the foil and holes; and a spring web unitarily formed with the sheet and with the panel and urging the panel into the rest position.

2. The blister pack defined in claim 1 wherein the spring web, panel, and sheet are of the same material and thickness.

3. The blister pack defined in claim 2 wherein the spring web has a pair of flat portions having outer edges joined to the panel and sheet and inner edges joined to each other.

4. The blister pack defined in claim 2 wherein the material is plastic.

5. The blister pack defined in claim 1 wherein the guide is a pair of inwardly bent lips formed at longitudinal edges of the sheet.

* * * * *